US005960729A

United States Patent [19]

Matsumoto et al.

[11] Patent Number: 5,960,729

[45] Date of Patent: Oct. 5, 1999

[54] PRESSING MEMBER WITH AIR EJECTOR FOR A SEWING MACHINE

[75] Inventors: Fumio Matsumoto; Kazunari Kobayashi, both of Toyonaka, Japan

[73] Assignee: Yamato Mishin Seizo Kabushiki Kaisha, Osaka, Japan

[21] Appl. No.: 09/086,255

[22] Filed: May 28, 1998

[30] Foreign Application Priority Data

Jun. 11, 1997 [JP] Japan ..... 9-154058

[51] Int. Cl.[6] ..... D05B 29/08; D05B 35/02; D05B 81/00

[52] U.S. Cl. ..... 112/235; 112/142; 112/129

[58] Field of Search ..... 112/235, 236, 112/240, 128, 141, 150, 151, 122, 122.1, 127, 147; 30/275; 83/936, 938

[56] References Cited

U.S. PATENT DOCUMENTS 2,915,996 12/1959 Charest ..... 112/122
4,526,113 7/1985 Angele ..... 112/127
4,928,610 5/1990 Akutsu ..... 112/235 X
5,205,231 4/1993 Sanvito et al. ..... 112/127 X
5,370,071 12/1994 Ackermann ..... 112/235 X
5,373,797 12/1994 Bottoms et al. ..... 112/141

*Primary Examiner*—Ismael Izaguirre
*Attorney, Agent, or Firm*—Darby & Darby

[57] ABSTRACT

A pressing member for a sewing machine arranged such that end portions of a pair of materials are sent into a guide path provided between a pair of presser feet extending in front of a needle drop point so that their upper hems are cut even by a lower knife and upper knife, wherein an air introduction pipe is connected to an upper surface of one presser foot, air is ejected towards a side of the other presser foot between an upper guide and lower guide being vertically overlapped rearward of the lower knife and upper knife, and air is sprayed onto one material on the same side so that this material can be securely overlapped onto the other material.

3 Claims, 6 Drawing Sheets

PRESSING MEMBER WITH AIR EJECTOR FOR A SEWING MACHINE

BACKGROUND OF THE INVENTION

1. Field of the Invention

The present invention relates to a pressing member that is comprised by a sewing machine for sewing edge hems of two materials together which are overlapped with each other by a specified width.

2. Description of the Prior Art

Back-shoulder seaming of shirts or sewing from crotch to cuff of briefs and shorts is generally performed by the following process: an interlock chain-stitch sewing machine (flat seamer sewing machine) having a cylinder bed of narrow width is employed, and materials which are cut into specified shapes are vertically overlapped with each other at their respective edge hems by a specified width, are sent into a needle drop point and sewn together. At this time, in order to obtain a sewn article of good quality, it is important to keep the overlapping width of the materials that are sent into the needle drop point at a proper width that corresponds to a sewing width of the sewing machine.

Adjusting of the overlapping width of the materials is generally performed manually by an operator who performs the sewing at a position in front of a pressing member for pinch-pressing and holding materials between this member and a throat plate, but it presents a drawback in that this operation requires considerable skill. Accordingly, a sewing machine which does not require manual adjustment of the overlapping width has been conventionally proposed for practical use which is realized by the arrangement of a special pressing member comprising knives for cutting edge hems of materials even which are to be objects to be sewn together, as well as a guide means provided rearward of the knives for overlapping materials which have been cut even.

FIG. 1 is a perspective view of a proximity of a needle drop point of an interlock chain-stitch sewing machine which is equipped with such a conventional pressing member comprising the knives and guide means as above described.

As shown in the drawing, a pressing member 2, which is supported in a suspended manner at a tip portion of a sewing machine arm A, comprises a guide path 21 formed between a pair of presser feet 22, 23 which elastically contact a throat plate D on a sewing machine bed B with an opening in a front side. Materials KL, KR, which are to be objects to be sewn, are pinch-pressed at a proximity of their respective end portions between the presser feet 22, 23 and the throat plate D, sent into a needle drop point C by being applied with a feed in a direction indicated by a non-relief arrow in the drawing by the action of a feed dog (not shown) extruding over the throat plate D, and sewn together by needles 1, 1 . . . dropping onto the needle drop point C.

In performing this feeding, when the materials KL, KR are introduced into the guide path 21 in a condition in which they are put together with their end portions standing up, these upper edges reach a contact portion of an lower knife 24 and an upper knife 25 on halfway the guide path 21 and are cut even. The evenly cut end portions of the materials KL, KR are vertically overlapped, sent into the needle drop point C by the action of an upper guide 29 which is provided as to be protruding to the side of the guide path 21 from one presser foot 23 and of a lower guide 32 protruding to the side of the guide path 21 from the other presser foot 22 (see FIGS. 2B to 2D), and are made to be sewn by the needles 1, 1 . . . at a proper overlapping width.

FIGS. 2A to 2E are explanatory diagrams showing cutting and overlapping actions of materials KL, KR that are performed as above described, wherein FIG. 2A is a sectional view of a proximity of a front end portion of the pressing member 2, FIG. 2B of a cutting position of the lower knife 24 and upper knife 25, FIGS. 2C and 2D of a position somewhat rearward with respect to the cutting position, and FIG. 2E of a direction which is crossing a feeding position of the materials KL, KR at the needle drop point C.

As shown in these drawings, the upper guide 29 increases in extruding length to the guide path 21 in approaching the needle drop point C and also in thickness, and as shown in FIG. 2D, it is arranged in a manner such that it succeeds to the other presser foot 22 in a front side of the needle drop point C.

Further, as shown in FIG. 1, the lower guide 32 on the side of the presser foot 22 is arranged as follows: it is uniformly formed with a slide plate 30 attached on a lower surface of the presser foot 22 as to extend from the front end up to the rear end; it forms a specified gap with respect to the throat place D arranged downward; it increases in extruding length to the guide path 21 in approaching the needle drop point C, similarly to the upper guide 29; and, as shown in FIG. 2C, it is overlapped with an lower portion of the upper guide 29 as to form a specified gap in a region from somewhat rearward the cutting position of the lower knife 24 and upper knife 25 up to a position immediately in front of the needle drop point C, as shown in FIG. 2D.

As shown in FIG. 2A, materials KL, KR are overlapped at their respective edge hems by a portion of a specified width, and this overlapping portion is introduced into the guide path 21 in a condition in which this overlapping portion is standing up on the throat plate D. In order to make this introduction easy, there may also be used an auxiliary bar (shown by virtual lines) for maintaining the overlapping portion of the materials KL, KR in a standing-up condition.

The materials KL, KR introduced in this manner reach, as shown in FIG. 2B, at the contact position of the upper knife 24 and lower knife 25, and their upper hems are cut even. At this cutting position, the upper guide 29 and lower guide 32 present a specified extruding length to the guide path 21, and the cutting is performed in a condition in which an end surface of the upper guide 29 contacts the material KR on the right side and an end surface of the lower guide 32 contacts the material KL on the left side.

As shown in FIGS. 2C and 2D, the material KL of which upper hem has been cut even is pushed from the left side by the lower guide 32 which increases in extruding length in a direction of the guide path 21 and is made to fall onto the throat plate D arranged below. On the other hand, the material KR is pushed from the right side by the upper guide 29 which increases in extruding length in a direction of the guide path 21, guided between the upper guide 29 and the lower guide 32 which is overlapping with a lower portion of the upper guide 29, reaches a very end of the lower guide 32, overlaps with an upper portion of the material KL on the throat plate D, and is sent into the needle drop point C in this condition, whereupon the overlapping portion is sewn together by the needles 1, 1 . . . dropping onto needle drop point C, as shown in FIG. 2E.

By roughly overlapping materials KL, KR at their respective end portions and sending them into the pressing member 2 in a condition in which they are standing up on the throat place D in this manner, their end hems cut even by the lower knife 24 and upper knife 25, are vertically overlapped by the action of the upper guide 29 and lower guide 32, and are sent into the needle drop point C, whereby sewing of materials KL, KR at substantially constant overlapping widths can be realized without the necessity of manually adjusting the overlapping width.

However, while overlapping by the action of the upper guide 29 and lower guide 32 in the above manner can be smoothly performed in case materials KL, KR have a suitable thickness and elasticity, it may be that in case thin materials KL, KR which are quite flexible are to be sewn, the end hem of the material KR, which is guided by the action of the upper guide 29 into a position between this upper guide 29 and the lower guide 32, is bent between both guides 29, 32 as shown by the broken line in FIGS. 2C and 2D. When the materials are sent to the needle drop point C in this condition, it may happen that the surface material (material KR) is sewn to the back material (material KL) with a part of the end hem of the surface material being flapped to result in a sub-standard sewn article as shown in FIG. 3.

BRIEF SUMMARY OF THE INVENTION

The main object of the present invention is to provide a pressing member for a sewing machine which is arranged to comprise an upper guide and a lower guide between knives for cutting hems of materials even and a needle drop point wherein the upper and lower guides perform an overlapping actions of evenly cut materials which is capable of reliably performing overlapping of materials by the action of both guides regardless of types of materials to be sewn, and is capable of effectively preventing generation of sewing failures accompanying deficiencies in overlapping.

The pressing member for a sewing machine of the present invention comprises a pair of presser feet which are provided in an extending manner in front of a needle drop point and elastically contact a throat plate, an upper guide and lower guide which are provided in an extruding manner at surfaces of the presser feet which respectively oppose with each other and as to be vertically overlapping such that a gap is formed between these halfway a guide path formed between these, and knives arranged at a position in front of an overlapping portion of these guides, wherein a pair of materials, which are individually pinched between the respective presser feet and the throat plate, are sent into the guide path with their end portions at which they are put together are made to stand up, their upper hems are cut even by the knives, and are respectively guided, one between the lower guide and the throat plate and the other between the upper guide and the lower guide such that they are vertically overlapped on the throat plate to be sent to the needle drop point, the pressing member further comprising air ejecting means which is provide at the overlapping portion of the upper guide and lower guide and which ejects air from a side of the presser foot at which the upper guide is provided in an extruding manner to a side of the presser foot at which the lower guide is provided in an extruding manner.

According to the present invention, by the air ejecting means, air is ejected to the overlapping portion of the upper guide and lower guide from a side of the presser foot at which the upper guide is provided in an extruding manner and sprayed onto a edge hem of an upper side of one material to be guided between both guides whereby bending of the edge hem between the upper guide and lower guide is prevented and thus overlapping with the other material guided to below the lower guide is reliably performed.

The air ejecting means further comprises an air passage which is provided in a piercing manner at the presser foot at which the upper guide is provided in an exerudig manner and which passes through an upper surface of the presser foot and a surface on which the upper guide is provided in an extruding manner, and an air introduction pipe linked to an open end to the upper surface of the presser foot of the air passage. Further, the air passage is provided such that the connecting end to the surface on which the upper guide is provided in an extruding manner is inclined towards the needle drop point.

The air ejecting means is arranged such that the air passage which connects an upper surface of one presser foot and a surface opposing the other one is provided in a piercing manner, the air introduction pipe is jointed to an open end to the upper surface without providing any extruding portions to the guide path, whereby the feeding of materials to the needle drop point is not obstructed. Further, by inclining an open end of the air passage which is to be an air ejecting opening towards the needle drop point in a diagonal rear direction and spraying air that is ejected from this open end to a proximity of the needle drop point, generation of sewing failures with end hems being flapped can be efficiently prevented.

The above and further objects and features of the invention will more fully be apparent from the following detailed description with accompanying drawings.

DETAILED DESCRIPTION OF THE INVENTION

Figure 4:
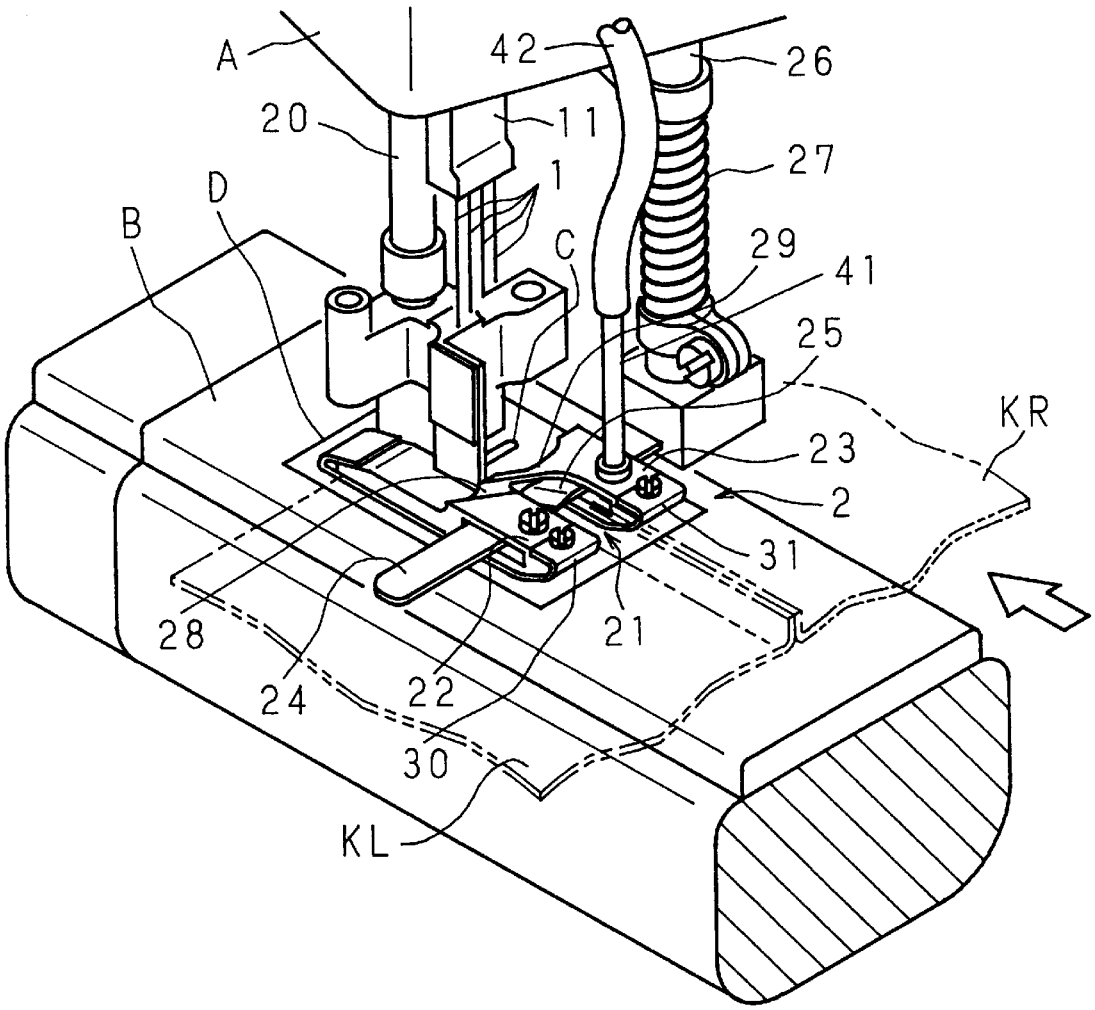
FIG. 4 is a perspective view of a proximity of a needle drop point of an interlock chain-stitch sewing machine equipped with a pressing member according to the present invention.

The present invention will now be explained in details based on the drawings showing an embodiment thereof. FIG. 4 is a perspective view of a proximity of a needle drop point of an interlock chain-stitch sewing machine equipped with a pressing member according to the present invention.

In the drawing, A denotes a sewing machine arm, and at a tip portion of the sewing machine arm A, there are provided a needle bar (not shown) and a presser bar 20 in a suspending-supported manner which are aligned in front and rear towards a sewing machine bed B arranged below. At a lower end of the needle bar, a plurality of needles 1, 1 . . . are attached via a needle stopper 11. At a lower end of the presser bar 20, there is fixed a pressing member 2 according to the present invention.

The needle bar is jointed to a main axis (not shown) built in the sewing machine arm A and is arranged to perform vertical movements at specified strokes accompanying the rotation of the main axis. The needles 1, 1 . . . attached to the needle bar via the needle stopper 11 are arranged, as shown in the drawing, to perform vertical movements between an upper position being remote from the pressing member 2 in an upward direction and a lower position reaching into the sewing machine bed B by passing through a needle drop point C.

Figure 1:
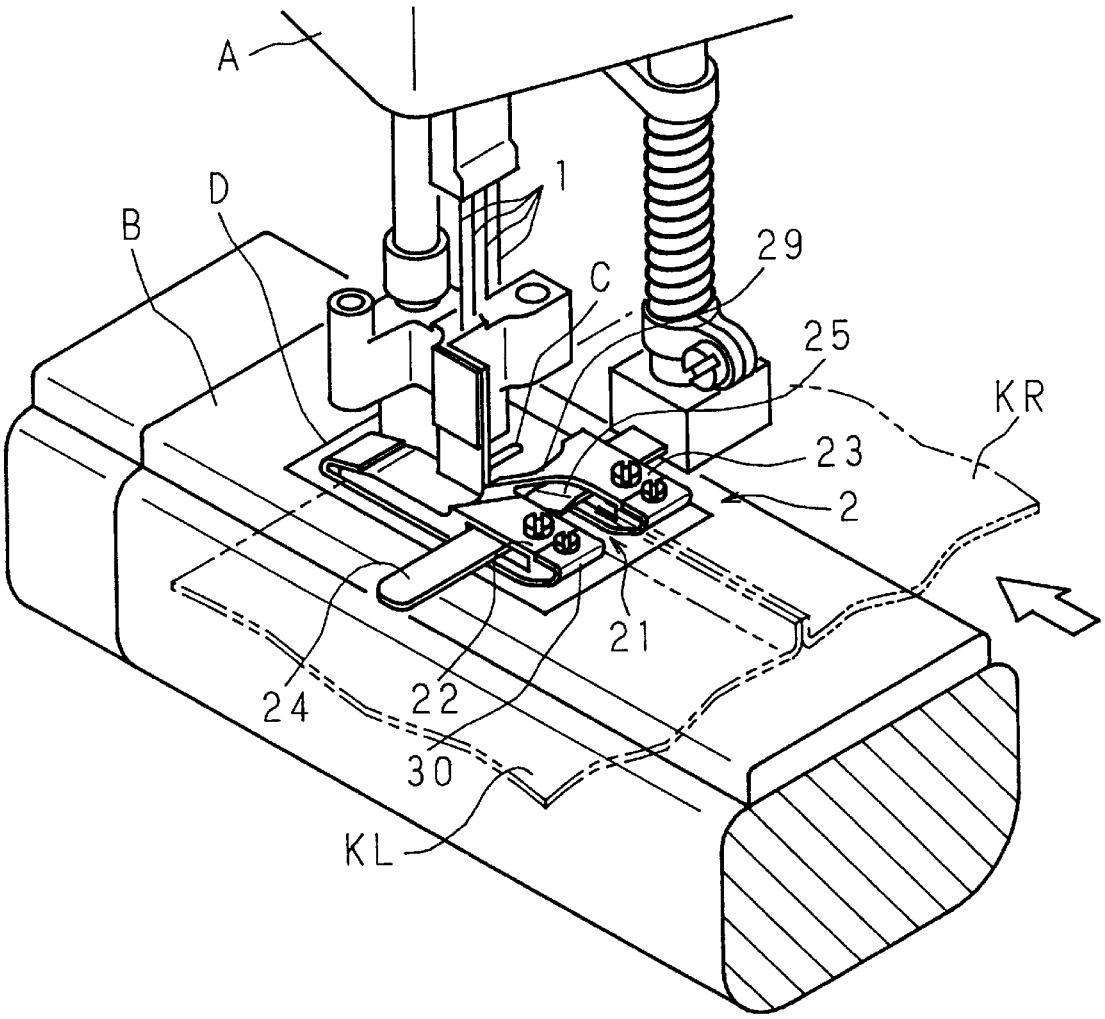
FIG. 1 PRIOR ART
FIG. 1 is a perspective view of a proximity of a needle drop point of an interlock chain-stitch sewing machine equipped with a conventional pressing member.
Figure 2A:
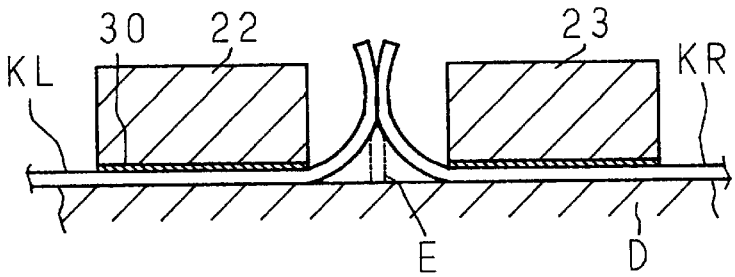
FIG. 2A PRIOR ART
FIGS. 2A to 2E are explanatory diagrams showing cutting and overlapping actions of materials by the conventional pressing member.
Figure 2B:
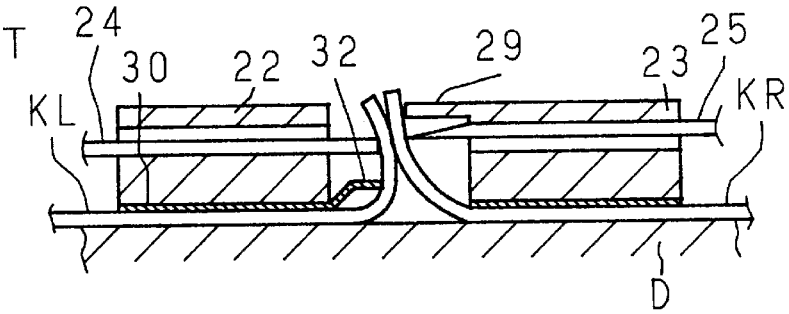
FIG. 2B PRIOR ART
Figure 2C:
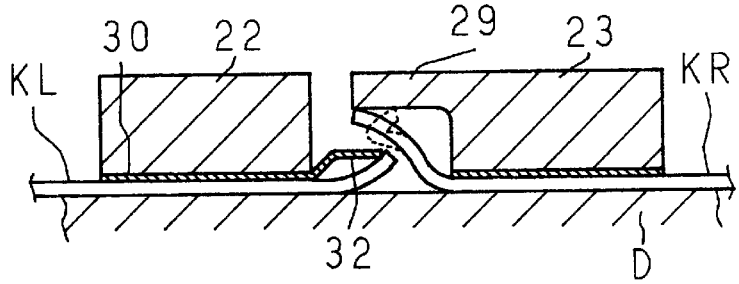
FIG. 2C PRIOR ART
Figure 2D:
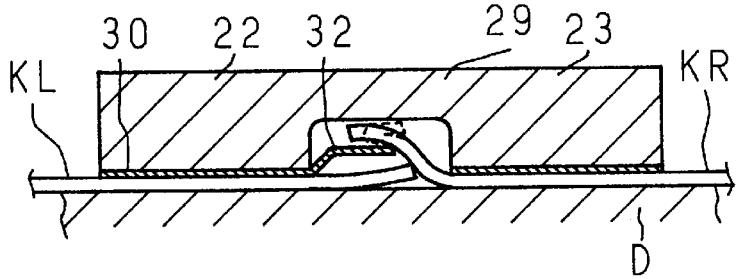
FIG. 2D PRIOR ART
Figure 2E:
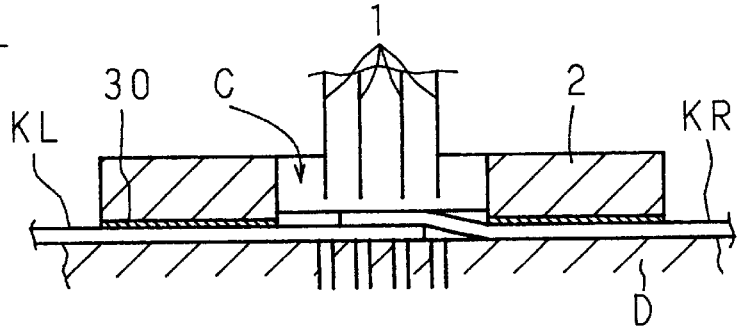
FIG. 2E PRIOR ART

The pressing member 2 according to the present invention comprises, similarly to the conventional pressing member 2 as shown in FIG. 1, a pair of presser feet 22, 23 which are provided in an extending manner in front of the needle drop point C and which elastically contact a throat plate D on the sewing machine bed B. Between these, a guide path 21 reaching to a front portion of the needle drop point C is formed. At one presser foot 22, a lower knife 24 is fixed with its blade surface facing into the guide path 21, and at the other presser foot 23, an upper knife 25 is held with its blade surface facing into the guide path 21 as to overlap with the blade surface of the lower knife 24.

A base end of the upper knife 25 extending to an outer side of the presser foot 23 is attached to a lower end of an operating rod 26 which is suspended from the sewing machine arm A on the same side, being energized in a downward direction by means of a coil spring 27 outwardly fitted thereto. The operating rod 26 is joined to the main axis (not shown) built in the sewing machine arm A and performs specified movements in linkage with rotations of the main axis. Accompanying these specified movements, the upper knife 25 is arranged to perform repetitive movements in a longitudinal direction of the lower knife 24, that is, a direction crossing the guide path 21 while maintaining a contacting condition with an upper surface of the lower knife 24 by the spring force of the coil spring 27.

By using a sewing machine of the above described arrangement, materials KL, KR which are objects to be sewn are pinched at a proximity of their respective end hems between the presser feet 22, 23 and throat plate D, are sent into the needle drop point C as shown by a non-relief arrow in the drawing by the action of a feeding dog (not shown) extruding onto the throat plate D, and are sewn together by the needles 1, 1 . . . dropping onto the needle drop point C. At this time, when the materials KL, KR are introduced into the guide path 21 between the presser feet 22, 23 with their respective end hems in a standing condition as shown in the drawing, these end hems reach a contact portion of the lower knife 24 and upper knife 25 accompanying the feeding, are cut even, and are sent into the needle drop point C thereafter in a vertically overlapping condition, whereby sewing at equal overlapping width can be realized without the necessity of manually adjusting the overlapping width.

Figure 5:
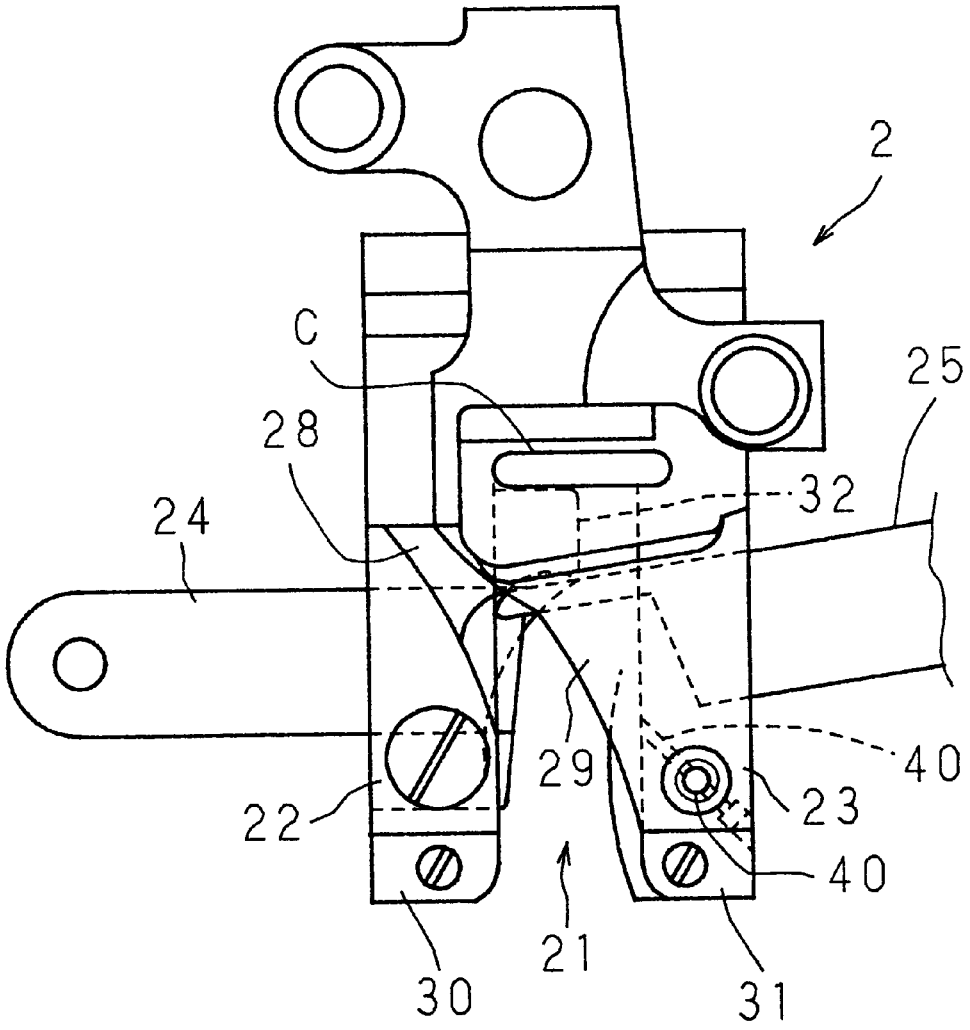
FIG. 5 is a plan view of the pressing member according to the present invention.

FIG. 5 is a plan view seen from above the pressing member 2. As shown in FIG. 5 and FIG. 4, there is formed a guide groove 28 on the upper surface of the pressing member 2 which extends from a very end portion of the guide path 21 in a diagonal rear direction as to succeed to an outer edge of the presser foot 22. Material ends that are cut by the lower knife 24 and upper knife 25 are guided to the outer side of the presser foot 22 by the guide groove 28 and are discharged without reaching the needle drop point C.

In an upper portion of the presser foot 23, there is provided in an extruding manner an upper guide 29 which protrudes to the side of the guide path 21 from a portion halfway thereof and in which protruding length increases in getting rearward (the side of the needle drop point C) to be succeeding to the guide groove 28.

The presser foot 22 is provided in an extruding manner with a lower guide 32 which increases in extruding length into the guide path 21 in approaching the needle drop point C, similarly to the upper guide 29. As shown in FIG. 5, the lower guide 32 is overlapped to a lower side of the upper guide 29 in a region from a rear side of the cutting position of the lower knife 24 and upper knife 25 up to a position immediately in front of the needle drop point C, and materials KL, KR which are cut even by the lower knife 24 and upper knife 25 are arranged to be vertically overlapping by an action of the upper guide 29 and the lower guide 32 as will be described later.

As shown in FIG. 4, there are attached onto the lower surface of the presser feet 22, 23 slide plates 30, 31 which extend from the respective front ends to rear ends of the presser feet. These are for providing actions of securing a specified sliding between the materials KL, KR pinched between the presser feet 22, 23 and the throat plate D and of performing smooth feeding movements by the feeding dog, and the lower guide 32 is uniformly arranged with the slide plate 30 at the side of the presser foot 22.

As shown in FIG. 5, the presser foot 23 on which the upper guide 29 is provided in an extruding manner is further provided with an air passage 40 in a manner as to connect an upper surface of a proximity of the front end portion of the presser foot 23 and an inner side surface of the presser foot 23 which opposes the guide path 21, that is, a surface on which the upper guide 29 is provided in an extruding manner. The air passage 40 as shown in the drawing is formed such that a vertical hole provided in a piercing manner from the upper surface of the presser foot 23 in a downward direction is connected to a portion halfway of a lateral hole which is likewise formed as to pierce through in a width direction and that an open end of this lateral hole to an outer surface of the presser foot 23 is blocked appropriately.

This lateral hole is provided in a piercing manner such that an open end to an inner surface of the presser foot 23 is inclined in a diagonal rear direction towards the needle drop point C. The vertical hole is arranged as a screw hole which inner face is formed as a screw, and as shown in FIG. 4, a base end portion of an air introduction pipe 41 is screwed and fixed at an open end to the upper surface of the presser foot 23. The air introduction pipe 41 is connected to an air source (not shown) through an air hose 42 fitted to its upper end portion, and air generated by the air source is made to be introduced to the air passage 40 via the air hose 42 and air introduction pipe 41.

The air passage 40 of the above described arrangement is formed of the vertical hole to which the air introduction pipe 41 is connected and the lateral hole which succeeds to a lower end of the vertical hole, and the lateral hole is open to the inner surface of the presser foot 23 in a diagonal rear direction towards the needle drop point C. Therefore, air introduced to the air passage 40 via the air introduction pipe 41 first progresses along the vertical hole, then changes its direction to a diagonal rear one, is ejected in a diagonal rear direction from the open end of the lateral hole and is sprayed to an overlapping portion of the upper guide 29 and lower guide 32.

Figure 6A:
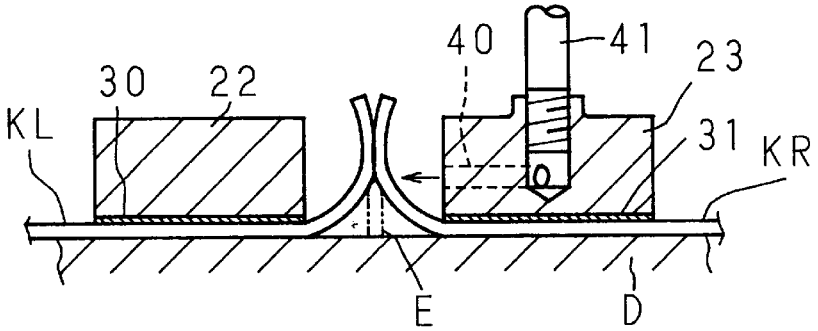
FIGS. 6A to 6E are explanatory diagrams showing cutting and overlapping actions of materials by the pressing member according to the present invention.

FIGS. 6A to 6E are explanatory diagrams showing cutting and overlapping operations of materials KL, KR performed in the sewing machine equipped with the pressing member 2 according to the present invention comprising the air passage 40 and air introduction pipe 41 as above described. FIG. 6A is a sectional view of a proximity of a front end portion of the pressing member 2, FIG. 6B of a cutting position of the lower knife 24 and upper knife 25, FIGS. 6C and 6D of a position somewhat rearward with respect to the cutting position, and FIG. 6E of a direction which crosses a feeding position of the materials KL, KR at the needle drop point C.

Figure 6B:
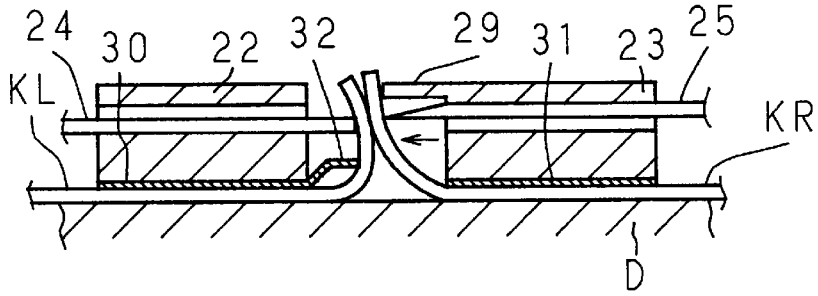
Figure 6C:
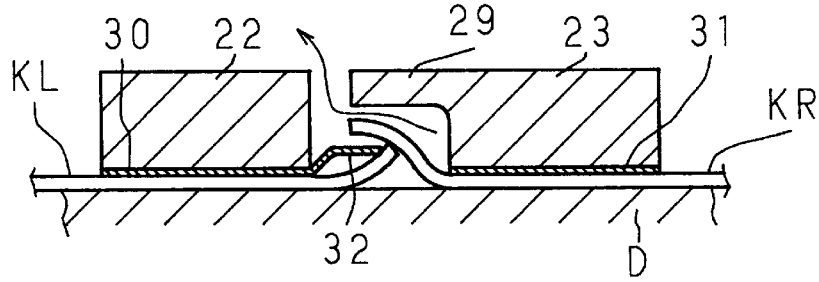
Figure 6D:
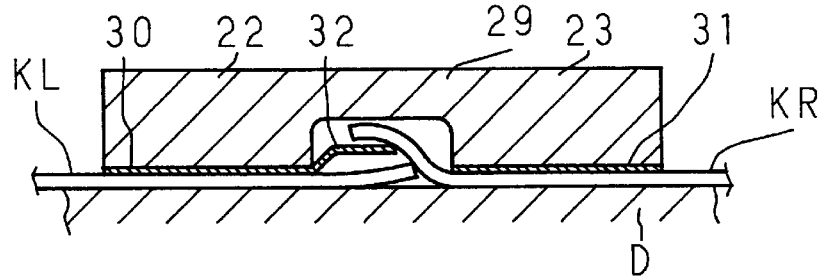

As shown in these drawings, the upper guide 29 increases in extruding length to the guide path 21 in approaching the needle drop point C and also in thickness, and as shown in FIG. 6D, it is arranged in a manner such that it succeeds to the other presser foot 22 in a front side of the needle drop point C. Further, the lower guide 32 is arranged in a manner such that a part of the guide plate 30 at the side of the presser foot 22 extruding into the guide path 21 is bent as shown in the drawing so that it is opposing the throat plate D arranged below in a substantially horizontal manner with a specified gap formed between.

As shown in FIG. 6A, a proximity of the respective end portions of the materials KL, KR are pinched between the presser feet 22, 23 and throat plate D, are overlapped at the end hems by a portion of a specified width, and are fed into the guide path 21 in a condition in which the overlapping portion is standing up on the throat plate D. In order to make this feeding easy, there may also be used an auxiliary bar E, as shown by the two-dot chain line in the drawing, for maintaining the overlapping portion of the materials KL, KR in a standing-up condition that is installed in substantially a center of the guide path 21 as to be substantially vertical with respect to the throat plate D.

The materials KL, KR fed in this manner reach, as shown in FIG. 6B, at the contact position of the upper knife 24 and lower knife 25, and their upper hems are cut even. At this cutting position, the upper guide 29 and lower guide 32 present a specified extruding length to the guide path 21, and the cutting is performed in a condition in which an end surface of the upper guide 29 contacts the material KR on the right side and an end surface of the lower guide 32 contacts the material KL on the left side.

The material KL on the side of the presser foot 22 of which upper hem has been cut even by the lower knife 24 and upper knife 25 approaches the needle drop point C as shown in FIGS. 6C and 6D accompanying a further feeding, and is pushed from the left side by the lower guide 32 which increases in extruding length into the guide path 21 to fall onto the throat plate D arranged below. The material KR is pushed from the right side by the upper guide 29 which increases in extruding length into the guide path 21 and is guided between the upper guide 29 and lower guide 32 which overlaps a lower side of the upper guide 29.

The pressing member 2 according to the present invention has, as shown in FIG. 6A, an air ejecting means which includes the air passage 40 and the air introduction pipe 41 in a proximity of a front end of the presser foot 23, wherein air is ejected into the guide path 21 from an inner surface of the presser foot 23. The air passage 40 is arranged as shown in FIG. 5, and air is ejected from a position that is in front of the cutting position as shown in FIG. 6B into a diagonal rear direction and is sprayed, as shown by arrows in FIGS. 6B and 6C, onto a surface of the material KR on the same side.

The upper portion of the material KR at the cutting position as shown in FIG. 6B is restricted by the lower knife 24 and upper knife 25 that are facing with each other, and air blown to the material KR at this position flows rearward and is sprayed to the overlapping portion of the upper guide 29 and lower guide 32. The upper portion of the material KR at this position is open so that most of the air flows in a direction of the end hem along the upper surface of the cut material KR to be discharged to the upper side of the guide path 21, and material KR is corrected by this air stream to extend its end hem and falls onto the upper surface of the lower guide 32.

Figure 3:
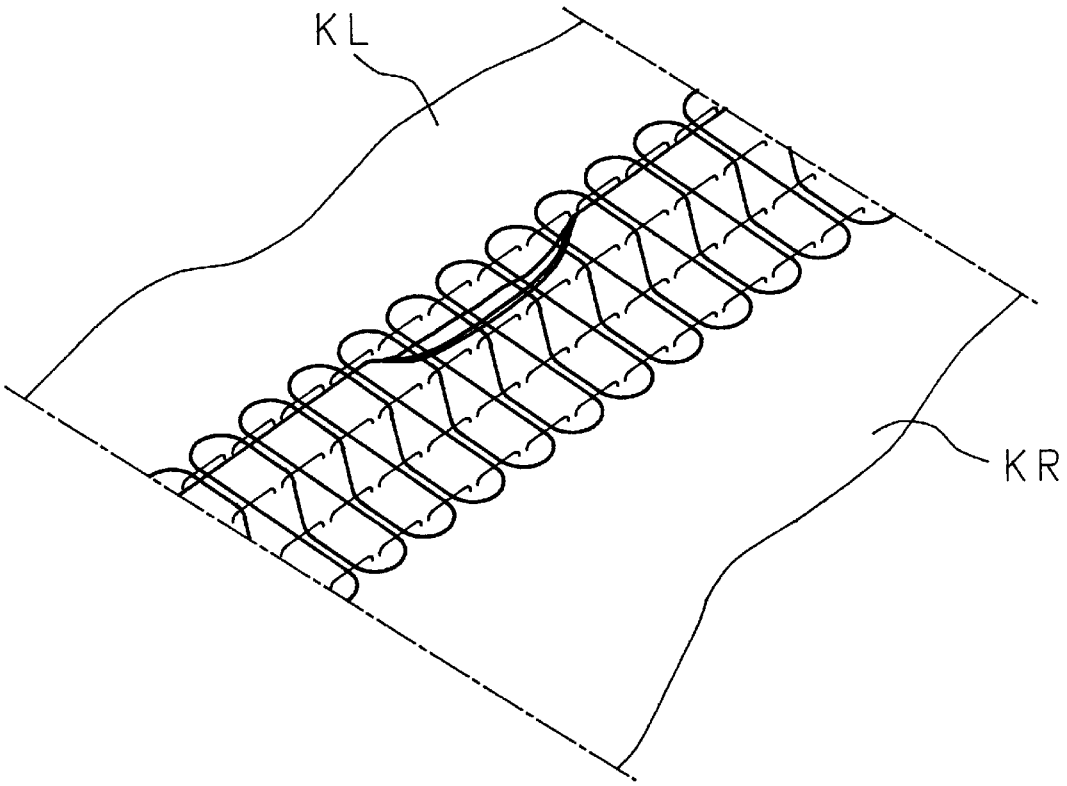
FIG. 3 PRIOR ART
FIG. 3 is a partially enlarged perspective view of a sub-standard sewn article that may be generated when using the conventional pressing member.
Figure 6E:
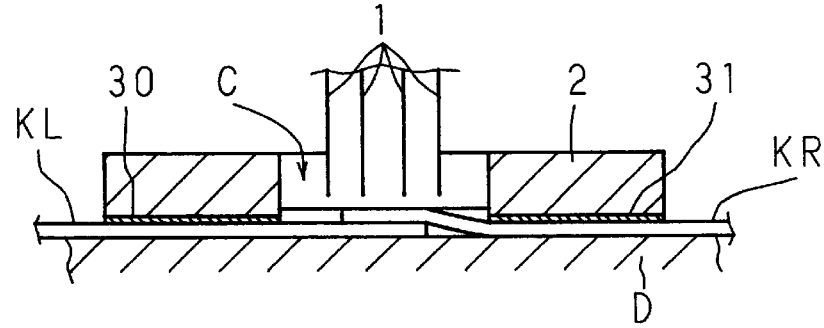

Material KR extended in this manner is overlapped onto the upper portion of the material KL on the throat plate D at a very end position of the lower guide 32, is sent into the needle drop point C in this condition, and sewn together by the needles 1, 1 . . . dropping onto the needle drop point C as shown in FIG. 6E. Since the end hem of material KR is in an extended condition due to the air stream, it can be prevented for generating sub-standard sewn articles in which the surface material (material KR) is sewn together with the back material (material KL) with a part of the end hem of the surface material being flapped, as shown in FIG. 3.

It should be noted that air ejected from the air passage 40 is discharged to the upper side of the guide path 21 as above described wherein this discharged air performs an action of introducing material ends that are cut by the lower knife 24 and upper knife 25 into the guide groove 28 whereby an additional effect of supporting discharge of material ends along guide groove 28 can be obtained.

The style for forming the air passage 40 is not limited to that as indicated in the above embodiment, and any style for forming may be employed unless air can be ejected to the overlapping portion of the upper guide 29 and lower guide 32. Further, the air passage 40 is not limited to be arranged in a piercing manner at the presser foot 23, and it may alternatively be arranged by fixing a pipe of suitable size to a corresponding position.

However, it is necessary to make sure that feeding of materials KL, KR is not obstructed by any elements of the air ejecting means protruding into the guide path 21, and also to make sure that the essential pressing operations of the materials KL, KR performed by the pressing member 2 is not hindered. In the above embodiment, the air ejecting means can be arranged by simply connecting the air introduction pipe 41 to the end of the air passage 40 which is open at the upper surface in the front end portion of the presser foot 23, so either the feeding of materials KL, KR or the pressing operations of the pressing member 2 is not obstructed.

The pressing member for a sewing machine according to the present invention is arranged to have an air ejecting means which is arranged between knives for cutting material ends and a needle drop point, wherein air is ejected onto an overlapping portion of an upper guide and lower guide provided for guiding materials of which end hems have been cut even by the knives, and air is made to be sprayed towards an end hem on an upper surface of the material guided between the upper guide and lower guide. With this arrangement, bending of the end hem of the material between the upper guide and lower guide can be effectively prevented, overlapping with the other material can be securely performed, and generation of sub-standard sewn articles accompanying deficiencies in overlapping can be prevented.

Also, the air ejecting means is arranged by connecting an air introduction pipe to an air passage provided in a piercing manner at one presser foot of the pressing member. With this arrangement, the air ejecting means can be simply arranged without the fear of obstructing feeding of materials and pressing operations that are essential to the pressing member.

Further, an open end of the air passage which is to be an ejecting opening for air is provided as to be inclined in a diagonal rear direction towards the needle drop point. With this arrangement, ejected air can be sprayed to a proximity of the needle drop point, and generation of sewn articles of which end hems are being flapped can be effectively prevented.

As this invention may be embodied in several forms without departing from the spirit of essential characteristics thereof, the present embodiment is therefore illustrative and not restrictive, since the scope of the invention is defined by the appended claims rather than by the description preceding them, and all changed that fall within metes and bounds of the claims, or equivalence of such metes and bounds thereof are therefore intended to be embraced by the claims.

We claim:

1. A pressing member for a sewing machine comprising:

a pair of presser feet which are provided in an extending manner in front of a needle drop point and elastically contact a throat plate;

an upper guide and lower guide which are provided in an extruding manner at surfaces of the pair of presser feet which respectively oppose with each other and as to be overlapping such that a gap is formed between these in a vertical direction halfway a guide path formed between the pair of presser feet;

knives arranged at a position in front of an overlapping portion of the upper guide and lower guide; and air ejecting means, provided at the overlapping portion of the upper guide and lower guide, for ejecting air from a side of the presser foot at which the upper guide is provided in an extruding manner to a side of the presser foot at which the lower guide is provided in an extruding manner, wherein a pair of materials, which are individually pinched between the respective presser feet and the throat plate, are sent into the guide path with their end portions at which they are put together are made to stand up, their upper hems are cut even by the knives, and are respectively guided, one between the lower guide and the throat plate and the other between the upper guide and the lower guide, such that they are vertically overlapped on the throat plate to be sent to the needle drop point.

2. The pressing member of claim 1, wherein the air ejecting means comprises an air passage which is provided in a piercing manner at the presser foot at which the upper guide is provided in an extruding manner and which passes an upper surface of the presser foot and a surface on which the upper guide is provided in an extruding manner, and an air introduction pipe linked to an open end to the upper surface of the presser foot of the air passage.

3. The pressing member of claim 2, wherein the air passage is provided such that the connecting end to the surface on which the upper guide is provided in an extruding manner is inclined towards the needle drop point.

* * * * *